US005224437A

United States Patent [19]

Stanescu

[11] Patent Number: 5,224,437

[45] Date of Patent: Jul. 6, 1993

[54] GANGPLANK OR LADDER FOR WATERCRAFT MADE UP OF SEVERAL ARTICULATED SECTIONS

[76] Inventor: Georgel V. Stanescu, Viale Calatafimi No. 36, Firenze, Italy

[21] Appl. No.: 785,047

[22] Filed: Oct. 30, 1991

[30] Foreign Application Priority Data

Oct. 31, 1990 [IT] Italy ..... 9517 A/90
Oct. 31, 1990 [IT] Italy ..... 9518 A/90

[51] Int. Cl.[5] ..... B63B 17/00
[52] U.S. Cl. ..... 114/362; 182/95
[58] Field of Search ..... 114/362, 347; 182/95

[56] References Cited

U.S. PATENT DOCUMENTS

| | | | |
|---|---|---|---|
| 2,536,966 | 1/1951 | Teller | 182/95 |
| 3,288,201 | 11/1966 | Floer . | |
| 3,980,157 | 9/1976 | Wrigley | 182/163 |
| 4,841,901 | 6/1989 | McGlew et al. | 114/347 |

FOREIGN PATENT DOCUMENTS

| | | | |
|---|---|---|---|
| 2302906 | 10/1976 | France | 114/362 |
| 2584672-Al | 7/1985 | France . | |
| 221794 | 12/1983 | Japan | 114/362 |
| 237887 | 9/1990 | Japan | 114/362 |
| 553161 | 5/1977 | U.S.S.R. | 114/362 |
| 1318482 | 6/1987 | U.S.S.R. | 114/362 |
| 14580 | of 1910 | United Kingdom | 212/250 |
| 1009737 | 11/1965 | United Kingdom . | |
| 1441464 | 6/1976 | United Kingdom | 114/362 |

OTHER PUBLICATIONS

Danfoss High Torque Turning Hitork Acutation.

*Primary Examiner*—Sherman Basinger
*Assistant Examiner*—Thomas J. Brahan
*Attorney, Agent, or Firm*—McGlew & Tuttle

[57] ABSTRACT

A gangplank or ladder for watercraft comprises at least two portions (1A, 1B) hinged together and suitable for taking up a folded position and an open position respectively, the first (1A) of said portions is hinged to the craft and rotates around an axis coinciding with the outlet axis of an actuator (7) preset for controlling the rotation of said first portion (1A) with respect to the hull of the craft (9).

8 Claims, 6 Drawing Sheets

GANGPLANK OR LADDER FOR WATERCRAFT MADE UP OF SEVERAL ARTICULATED SECTIONS

FIELD OF THE INVENTION

The invention relates to a gangplank or ladder for watercraft comprising at least two portions hinged together to take up a folded position and an open position respectively, the first of said portions being hinged to the craft.

BACKGROUND OF THE INVENTION

A gangplank-ladder of this type is described for example in the Italian industrial utility model application No. 4225 B/86. The two portions of the gangplank described in this previous patent are hinged together by means of a pair of triangular plates to which pairs of actuators in the form of cylinder-pistons are fastened, hinged at one end to the said plate and at the opposite end to one or the other of the two portions of the gangplank. This configuration is particularly complex and cumbersome and, in addition, requires very many connections to the hydraulic system for controlling the actuators.

The first portion, that is the upper portion of the gangplank, is hinged to the craft and its oscillation with respect to the hull is obtained by means of a cylinder-piston system connected to the gangplank by means of a system of levers. This type of control also is complex and very cumbersome.

SUMMARY AND OBJECT OF THE INVENTION

One aim of the present invention is to realize a ladder or gangplank of the mentioned type, in which the connection to the craft and the control of the oscillation with respect to the latter is brought about in a more efficient and simpler manner, with a reduction of the actuator members.

This aim is achieved, according to the invention, by foreseeing the first portion of the gangplank, that is the upper portion, rotating with respect to the craft around an axis coinciding with a rotating outlet axis of an actuator preset to operate the rotation of said first portion with respect to the hull of the craft. In this way the need for any type of transmission or leverage is eliminated. The actuator used may be any type of actuator which has a rotating outlet shaft and a sufficient torque to manoeuvre the whole gangplank. For example, a hydraulic motor may be used.

According to an improvement of the gangplank of the present invention, a further aim is achieved, which is that of realizing a gangplank in which the reciprocal articulation of the two or more portions it consists of and the opening and closing control of said portions takes place in a more efficient, simpler and less cumbersome manner.

This can be obtained, for example, with a gangplank of the described type, comprising at least one rotating blade actuator forming an active hinge between two consecutive portions of the gangplank.

On the other hand, a system may also be foreseen with a cylinder-piston actuator associated with the bridgeboard of the gangplank and connected by means of a system of drag cables to pulleys fastened to the portions of the gangplank.

Further advantageous embodiments of the gangplank according to the invention are shown in the appended dependent claims.

BRIEF DESCRIPTION OF THE DRAWINGS

The invention will be more easily understood by following the description and the appended drawings, which show a practical, non restrictive embodiment of the present invention. In the drawing:

FIGS. 10 and 11 show a detail of a modified embodiment, in which FIG. 10 is a section taken along line X—X in FIG. 11 and FIG. 11 is a view taken along line XI—XI in FIG. 10.

DETAILED DESCRIPTION OF THE PREFERRED EMBODIMENT

Figure 2:
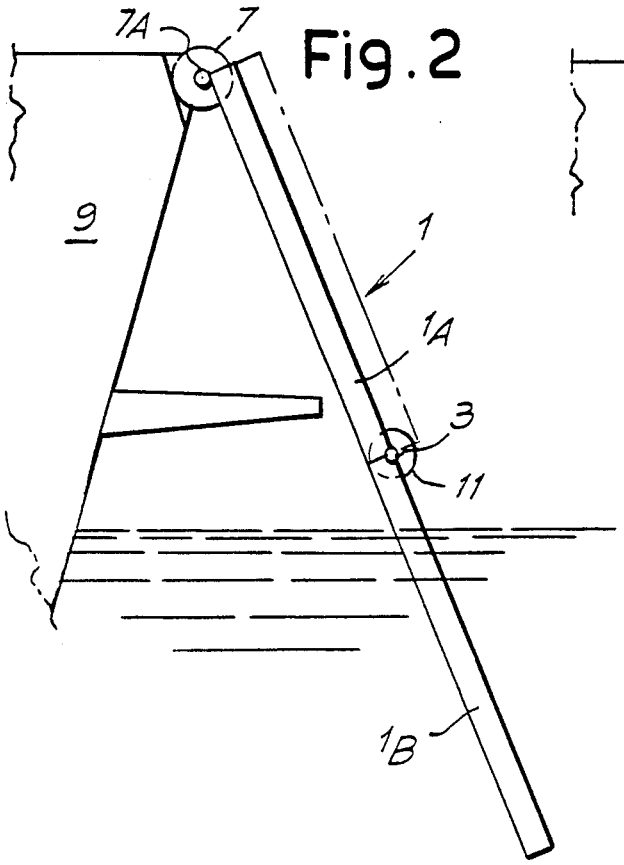
FIGS 1 and 2 show in diagrammatic form a gangplank according to the invention in a folded position and extended position respectively.
Figure 1:
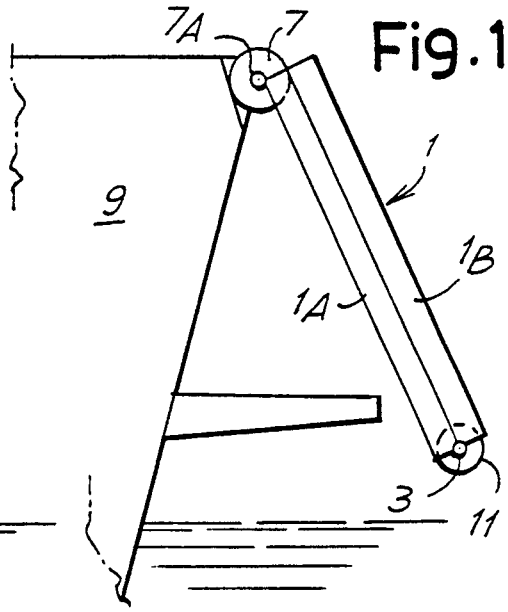

The Figures from 1 to 6, in which the same reference numerals are used to show equal or similar parts, show a ladder or gangplank for watercrafts in diagrammatic form, realized with a hinge according to the invention. FIGS. 1 and 2 show a ladder 1 in two portions 1A and 1B, hinged together at 3 and connected, by means of a high torque actuator 7, to the hull or a craft. The portions 1A, 1B can take up a folded position, in which they are moved close together, as shown in FIG. 1, and an extended position (FIG. 2) for use.

Figure 3:
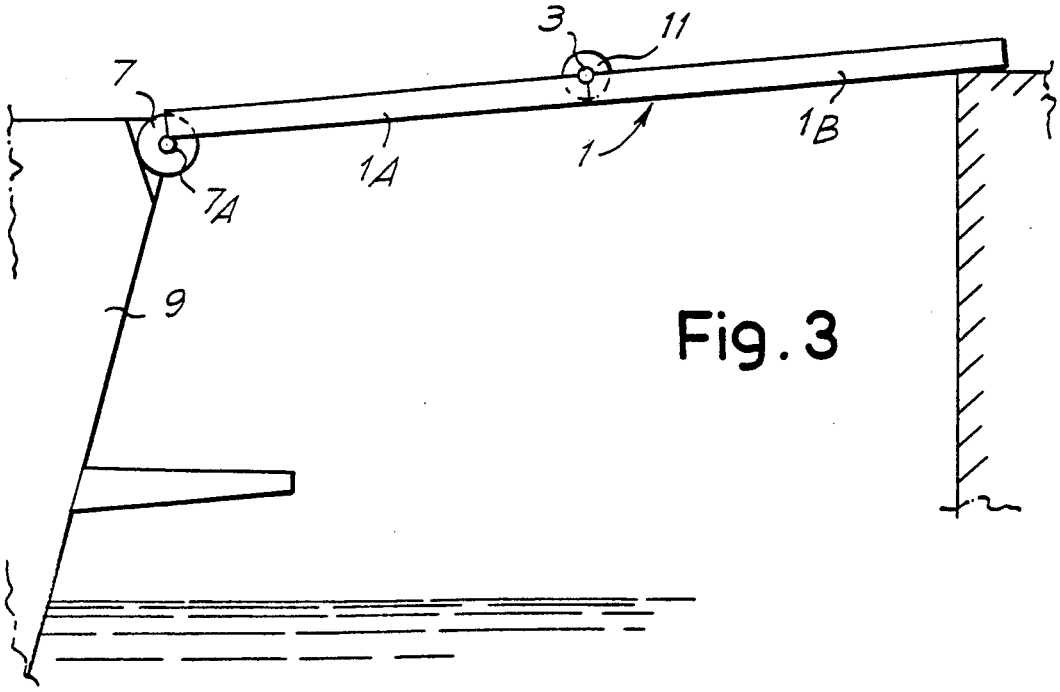
FIG. 3 shows a gangplank according to the invention in the position for use.

FIG. 3 shows a gangplank 1 in the position for use, also realized in two portions 1A and 1B hinged together at 3 and connected by means of an actuator 7 to the hull of the craft 9. The gangplank shown in FIG. 3 could be the same ladder shown in FIGS. 1 and 2, which carries out the double function of ladder and gangplank.

Figure 4:
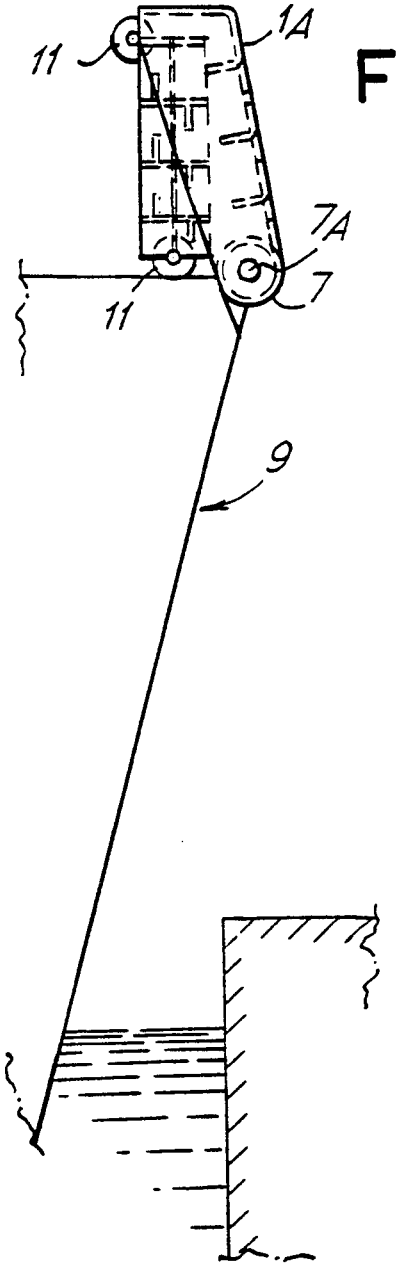
FIGS. 4, 5 and 6 show a folding ladder with three sections, re-entering within the railing of the craft.
Figure 5:
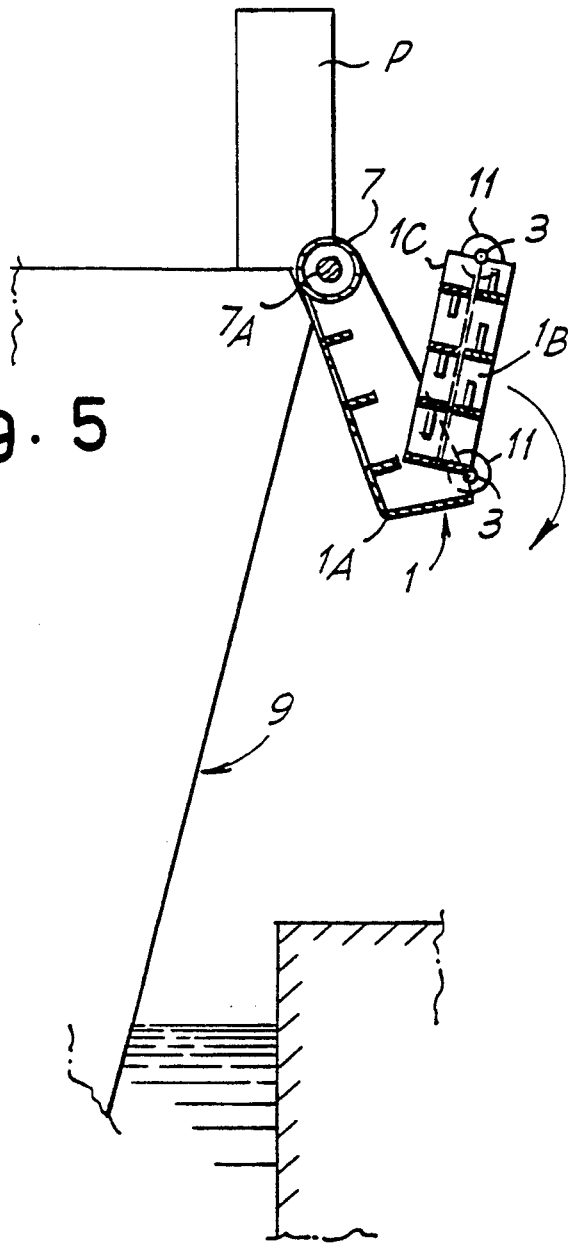
Figure 6:
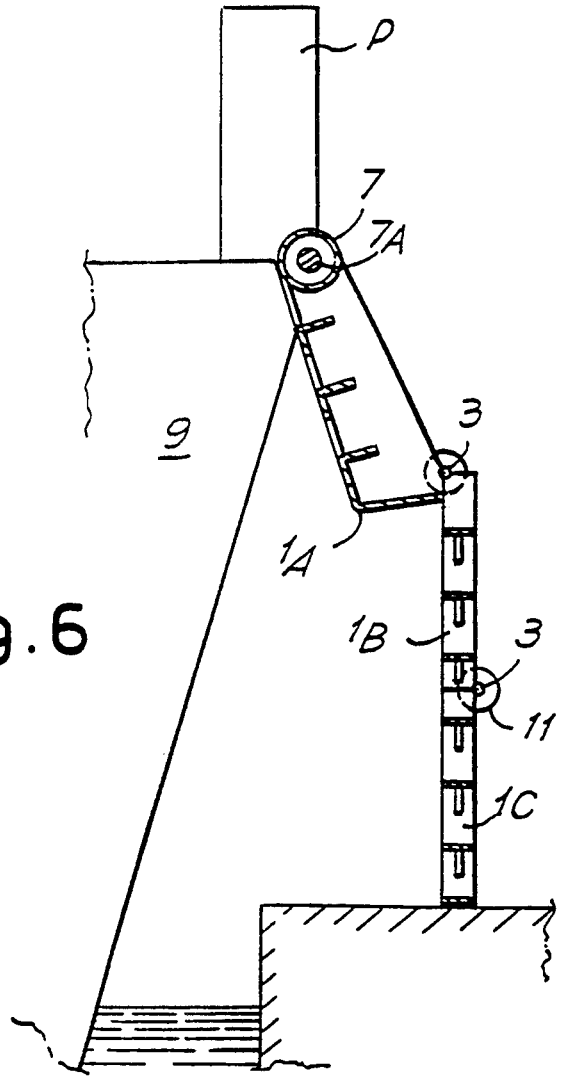

The ladder in the Figures from 4 and 6 has three sections 1A, 1B, 1C articulated together; the first section 1A is articulated to the hull of the craft also and makes up part of the rail P within which the ladder 1 re-enters when in the folded position (FIG. 4).

The upper portion 1A of the ladder or gangplank in the Figures from 1 to 6 is hinged to the hull of the craft around an axis which coincides with the outlet axis 7A of the actuator 7, which can be a hydraulic motor or another suitable actuator with sufficient torque. In this way a control system is obtained which is extremely compact and has no leverages or transmissions of any type.

As shown in diagrammatic form in the Figures from 1 to 6, the portions 1A, 1B and 1C of the ladder or of the gangplank are connected to each other by means of a pair of hinges 11 (one for each bridgeboard of the gangplank or ladder), which will be described in greater detail below with reference to the Figures from 7 to 9.

Figure 7:
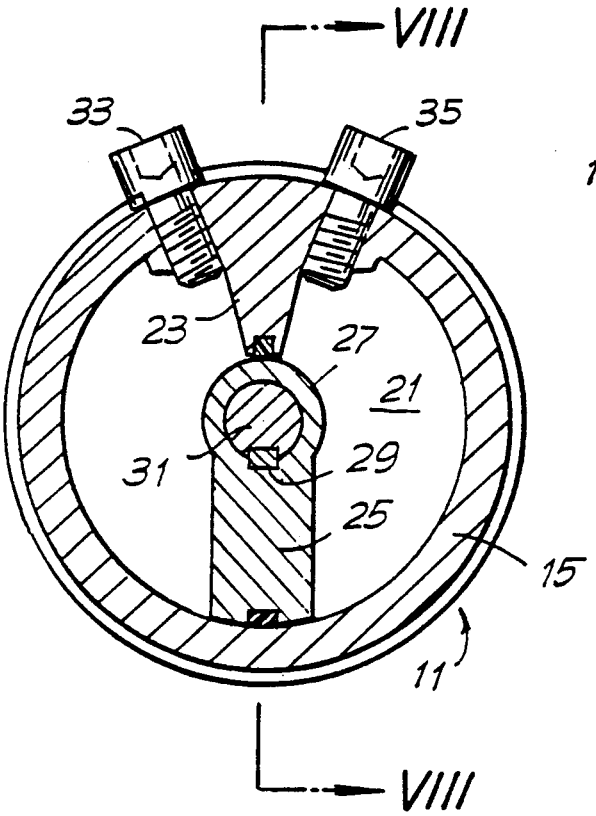
FIG. 7 shows an axial section of the hinge of the gangplank or ladder according to the invention, taken along the line VII—VII in FIG. 8.
Figure 8:
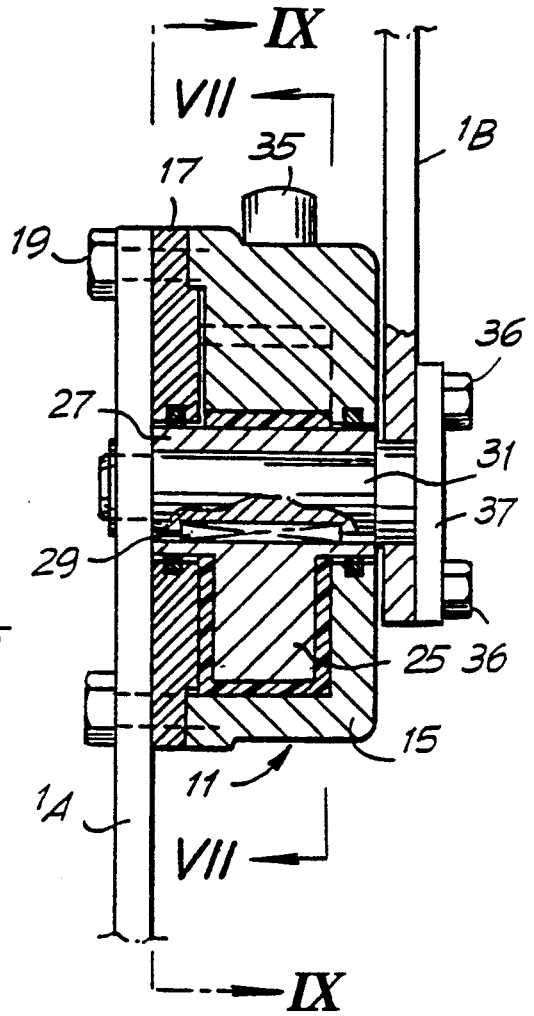
FIG. 8 shows a transverse section of the hinge in FIG. 7, taken along the line VIII—VIII in FIG. 7.
Figure 9:
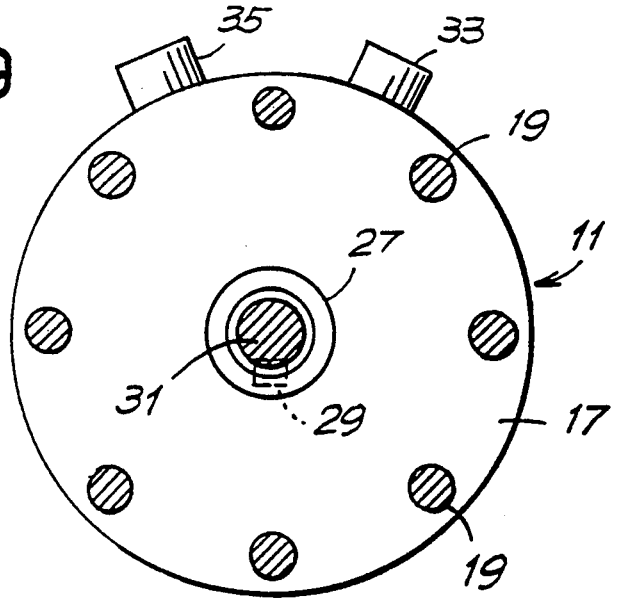
FIG. 9 shows an external view taken along the line IX—IX in FIG. 8.

In practice, each hinge 11 forms at the same time an actuator for controlling the relative rotation of the two portions 1A, 1B or 1B, 1C. As shown in detail in the Figures from 7 to 9, with reference for example to the portions 1A and 1B, each hinge 11 is made up of a case forming a body 15 and of a disc-shaped lid 17 fastened to the body 15 by means of screws 19. Inside the body 15 there is a substantially annular chamber 21 with a radial division 23 (FIG. 7). Inside the annular chamber 21 a blade 25 is positioned integral with a sleeve 27, which is in turn fastened by means of a tab 29 to a pin 31. The blade 25 and the radial division 23 divide the annular chamber 21 into two compartments with variable volume. When the blade 25 rotates around the axis of the pin 31, one of the two compartments increases and the other decreases. Two ducts 33, 35 for the inlet of a fluid under pressure open into the two compartments of the annular chamber defined by the blade 25 and the radial division 23. The letting in of the fluid under pressure into one or the other of the two compartments causes the blade 25 to rotate in one direction or the other. In fact, the hinge 11 is formed by a rotating hydraulic (or pneumatic) actuator.

One of the two portions 1A, 1B of the gangplank or ladder 1, portion 1A in the illustrated example, is made integral with a disc-shaped lid 17 and the body 15 by means of the same screws 19 which fasten the two portions 17 and 15 together. The other portion (portion 1B in the illustrated example) is fastened by means of screws 36 to a flange 37 integral with the pin 31. Therefore a relative rotation between the blade 25 and the body 15, 17 of the actuator causes a relative rotation of the portions 1A, 1B of the gangplank. It is clear that two active hinges, that is ones realized with an actuator of the type illustrated in the Figures from 7 to 9, can be interposed between two consecutive portions of the gangplank, but it is also possible to foresee a passive hinge, that is one without an actuator, and an active hinge.

Figure 11:
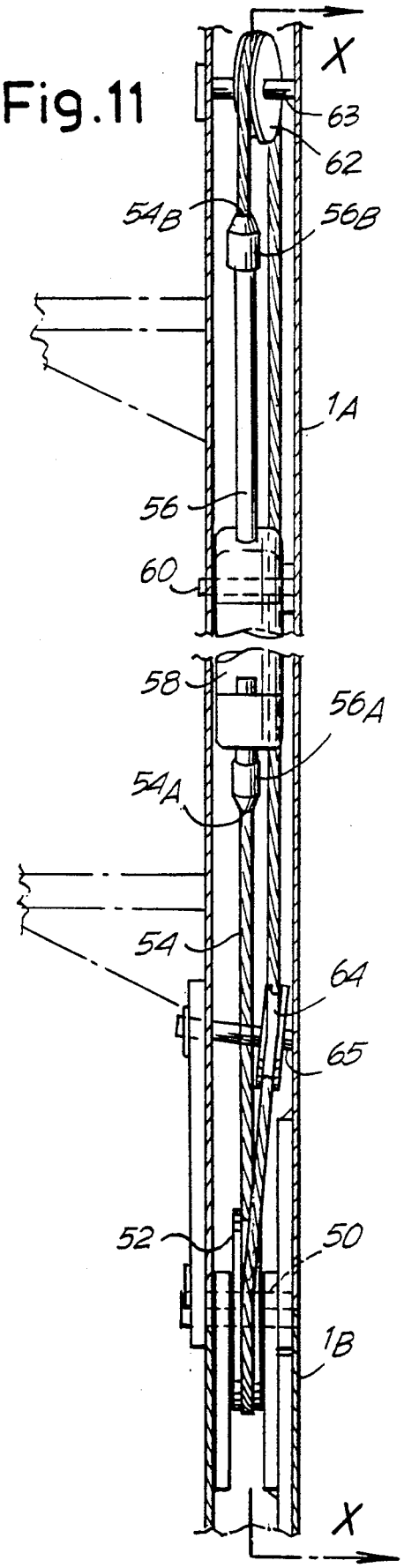
Figure 10:
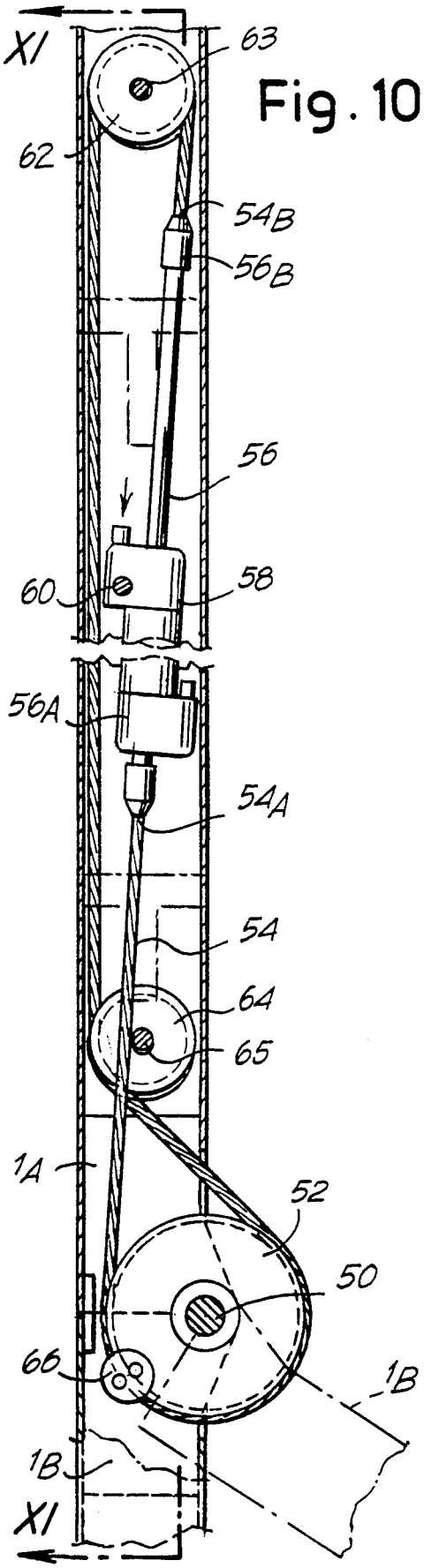

FIGS. 10 and 11 show an embodiment with a different system for the control of the reciprocal rotation of the portions 1A, 1B. In said Figures, the portions of the gangplank 1A and 1B are represented by one of the bridgeboards of the portions 1A and 1B. Said portions are reciprocally hinged at 50. A pulley or sheave 52, which rotates integrally with portion 1B around the axis of the pin 50 with respect to portion 1A, is fastened integrally with the portion 1B. A cable 54 winds around the pulley 52, one of its ends, shown with 54A, being fastened to one end 56A or a rod 56 of a cylinder-piston system 58. The other end of the cable 54, shown with 54B, is fastened to the other end 56B of the rod 56. The cylinder-piston system 58 is fastened at 60 to the portion 1A of the gangplank. The cable 54 winds, as well as around the pulley 52, around a pair of further pulleys 62, 64 also, of small diameter and idle-mounted on the respective pins 63, 64 fastened to the portion 1A of the gangplank. An anchoring means 66 fastens the cable 54 to the pulley 52 and to the portion 1B of the gangplank.

When the rod 56 moves along the cylinder of the cylinder-piston system 58, through the effect of the control fluid, the cable 54 moves, causing the pulley 52 (and therefore the portion 1B of the gangplank) to rotate around the axis 50. In this way the control of the two portions 1A, 1B with the portion 1B turning over onto the portion 1A, is obtained. The entire control system can be housed in the bridgeboards of the gangplank or ladder, taking up the minimum amount of space. In addition, in this case also one single actuator can be foreseen on one bridgeboard of the ladder, or two actuators arranged symmetrically on the two bridgeboards, with respective control cables 54.

In the case of the three-section ladder in the Figures from 4 to 6, another pulley 52 will be foreseen on the hinging axis of the sections 1B and 1C, integral with section 1C, on which a cable is wound and fastened, passing also on the other pulley 52, shown in Figures 10 and 11, which can possibly be an extension of the cable 54 illustrated there.

It is understood that the drawing shows an example only, which is given merely as a practical illustration of the invention, and that the invention can vary in forms and arrangements without going beyond the protection limits of the following claims.

I claim:

1. A gangplank ladder for watercraft, comprising:

at least a first gangplank ladder portion hinged to the watercraft about a substantially horizontal axis; a second gangplank ladder portion provided with a hinge connection to said first portion; a first high-torque rotating hydraulic actuator connected to the watercraft, said first high-torque hydraulic actuator having an output shaft; said first portion being connected to said output shaft, said output shaft having an axis of rotation which is parallel to steps of said first gangplank ladder portion coinciding with an axis of rotation of said first portion with respect to said watercraft to define said first portion hinge; a further hydraulic actuator being housed within a bridgeboard formed in one of said first portion and second portion said further hydraulic actuator forming said hinge connection to said first portion.

2. A gangplank ladder according to claim 1, wherein one of said first portion and said second portion is fastened to a body of said further hydraulic actuator and said further hydraulic actuator is housed with said shaft connected to the other of said first portion and second portion.

3. A gangplank ladder according to claim 1, wherein a pulley is mounted within the bridgeboard of one of said first portion and second portion and an idle pulley is provided within the bridge board of the other of said first portion and said second portion, said further actuator being connected to a flexible member wound around said pulley and wound around said idle pulley.

4. A gangplank ladder according to claim 3, wherein said further hydraulic actuator is a double-acting cylinder piston system with a rod having an end protruding from a cylinder, ends of said flexible member being anchored to ends of said rod.

5. A gangplank ladder according to claim 1, further comprising a rail provided on said watercraft, said rail defining a housing, said first and second portions being foldable and pivotable about said hinge for positioning said gangplank ladder within said rail housing.

6. A gangplank ladder for watercraft, comprising:

a first bridgeboard portion; a second bridgeboard portion; a high-torque hydraulic actuator connected to said watercraft and connected to said first bridgeboard portion, said high-torque hydraulic actuator including a shaft extending parallel to steps of the gangplank ladder, said high-torque hydraulic actuator and said shaft being connected to said watercraft and said first bridgeboard portion for pivoting said first bridgeboard portion with respect to said watercraft around a hinge axis corresponding to said shaft; a further high-torque hydraulic actuator connected to each of said first bridgeboard portion and said second bridgeboard portion for pivoting of said first bridgeboard portion with respect to said second bridgeboard portion, one of said first bridgeboard portion and said second bridgeboard portion defining a housing for receiving said further high-torque hydraulic actuator therein.

7. A gangplank ladder for watercraft, comprising:

a first bridgeboard portion including laterally extending steps; a second bridgeboard portion including laterally extending steps; a high-torque hydraulic actuator having a radial dimension which is much smaller than an axial dimension thereof, said high-torque actuator being connected to said watercraft and being connected to said first bridgeboard portion under a first of said steps, said high-torque hydraulic actuator including an axially extending output shaft, said high-torque hydraulic actuator and said axially extending output shaft being connected to said watercraft and said first bridgeboard portion for pivoting said first bridgeboard portion with respect to said watercraft around a hinge axis corresponding to said axially extending output shaft; a further high-torque hydraulic actuator connected to each of said first bridgeboard portion and said second bridgeboard portion for pivoting of said first bridgeboard portion with respect to said second bridgeboard portion, one of said first bridgeboard portion and said second bridgeboard portion defining a housing for receiving said further high-torque hydraulic actuator therein.

8. A gangplank ladder according to claim 7, wherein said further hydraulic actuator has a radial dimension which is much smaller than an axial dimension thereof including an axially extending output shaft.

* * * * *